United States Patent [19]

Hauke

[11] 4,105,060

[45] Aug. 8, 1978

[54] CHILL CASTING METHOD AND APPARATUS

[75] Inventor: Wilhelm Hauke, Hilzingen, Germany

[73] Assignee: Georg Fischer Aktiengesellschaft, Schaffhausen, Switzerland

[21] Appl. No.: 736,139

[22] Filed: Oct. 27, 1976

[30] Foreign Application Priority Data

Oct. 31, 1975 [CH] Switzerland ..... 14104/75

[51] Int. Cl.[2] ..... B22C 9/20

[52] U.S. Cl. ..... 164/130; 164/263; 164/324

[58] Field of Search ..... 164/263, 324, 130

[56] References Cited

U.S. PATENT DOCUMENTS

| | | | |
|---|---|---|---|
| 1,319,673 | 10/1919 | Stephenson | 164/263 |
| 1,319,674 | 10/1919 | Stephenson | 164/263 |
| 1,863,371 | 6/1932 | Greene | 164/263 X |
| 2,486,388 | 11/1949 | Brinton | 164/263 |
| 3,517,728 | 6/1970 | Taccone | 164/324 X |
| 3,645,321 | 2/1972 | Robinson | 164/324 |
| 3,840,066 | 10/1974 | Taccone | 164/130 X |
| 3,976,120 | 8/1976 | Raab | 164/130 X |

FOREIGN PATENT DOCUMENTS

| | | | |
|---|---|---|---|
| 1,211,605 | 10/1959 | France | 164/130 |

*Primary Examiner*—Robert L. Spicer, Jr.
*Attorney, Agent, or Firm*—Toren, McGeady and Stanger

[57] ABSTRACT

A series of chill mold sections each including a pair of opposed joinder faces each having a partial mold cavity defined therein are arranged to move in an endless path upon a conveyor device during casting. A teeming station and a mold emptying station are located at different points along the endless path of the mold sections and the conveyor device operates to join together the joinder faces of adjacent molds to form a mold cavity therebetween during at least a part of the travel of the mold sections along the endless path including the teeming station with the mold sections being separated from each other by operation of the conveying device during another portion of the endless path including the emptying station.

8 Claims, 4 Drawing Figures

CHILL CASTING METHOD AND APPARATUS

BACKGROUND OF THE INVENTION

The present invention relates generally to chill casting apparatus and more particularly to the structure and arrangement of chill mold sections and a method for chill casting of parts by movement of the chill mold sections along an endless path during casting operation.

In the casting of the shaped parts in chill molds, it has been customary to use chill molds which consist of two halves joined together by an opening and closing mechanism with the halves of the mold when joined together forming a mold cavity. For automated operation, several such chill molds are placed on a conveyor device or truck whereby they are moved in a particular sequence through various stations along a circular path or track. Such arrangements generally involve relatively elaborate structures and large moving masses, in addition to the chill molds which are utilized.

As a result, in the casting operations there will be required relatively long station times and high maintenance costs with changeover of the apparatus being rather complicated.

In addition to the arrangements mentioned above, it is also known in the casting of mill balls, for example, to provide a set of separate chill molds with two opposing joinder faces with the chill molds revolving around a closed path or track. The joinder faces when brought together form a completed mold cavity and an example of such a device is U.S. Pat. No. 2,486,388. A part of the chill molds on the revolving track or path forms a closed stack which leads past the teeming point up to an emptying point where each chill mold is temporarily accelerated away from the stack. In this known arrangement, the joint faces of adjacent ingot molds are spaced from each other only at the emptying point. The return of the chill molds is effected again in a closed stack parallel tc the first mentioned stack. From the end of the returning stack to the start of the leading stack the chill molds are displaced transversely to the direction of the stack and the joint faces and sliding on each other. This results in that the mold cavities are practically inaccessible upon the entire revolving track and that some necessary or desirable operations are not possible in the chill casting operations. For these reasons, only geometrically simple or coreless parts can be produced with this known arrangement since these types of devices present no problem with regard to the casting material.

The present invention is directed toward an arrangement which will permit the production of more complicated and intricate molded parts utilizing a chill casting method of the type which requires particularly the insertion of cores and the influencing of chill molds on their revolving track. Thus, the invention is aimed toward the provision of a method and apparatus whereby chill molding techniques may be simplified and more complex parts may be produced in a casting arrangement with greater ease and with lower costs.

SUMMARY OF THE INVENTION

Briefly, the present invention may be described as a method and apparatus for effecting a casting operation wherein a plurality of chill mold sections each including a pair of opposed joinder faces each having a partial mold cavity defined therein, are moved along an endless path by conveyor means which bring each of the mold sections together so that each of the joinder faces of each of said mold sections may be brought into abutting relationship so that a completed mold cavity is formed between a pair of adjacent abutting mold sections, with the mold sections being subsequently separated as they are moved about the endless path by the conveyor means.

The mold sections are moved at a higher velocity about that portion of the endless path where the mold sections are separated and at a lower velocity around that portion of the endless path where the mold sections are brought together into abutting relationship. Thus, as chill mold sections are moved on their endless revolving path they are brought together to form a horizontal stack with the joinder faces abutting each other with each of the mold sections being removed from said horizontal stack when the mold sections are separated.

In the operation of the invention, when the chill molds are moved on their revolving path along a portion thereof beyond the horizontal stack wherein the joinder faces are maintained spaced away from each other, they are conducted in the longitudinal direction of the stack when opening up to the last mold of the stack. This makes it possible to inspect or otherwise check the mold cavities on the revolving chill molds and to clean them, to apply backwash, to insert cores and to perform other similar operations. Furthermore, it is possible over the exposed joint faces to influence the temperature of the mold, and particularly to cool the mold so that the weight of the chill mold may be selected lower compared to the casting weight.

The invention is also concerned with the structure of the chill molds for carrying out the method of the invention and particularly to the provision of a set of such chill molds. Chill molds known from U.S. Pat. No. 2,486,388 have on their upper side a depression leading to the partial mold cavities in order to form a casting base. These depressions form a casting channel when arranged in series along the stack. In this casting channel there is formed in the known arrangement, starting from the teeming point of the casting apparatus a continuous rope joining the shaped castings with each other. It is therefore necessary to provide during the pouring transverse grooves in the metal rope and to break the rope after it has solidified at these transverse grooves by moving the chill molds over a hump existing on the bottom of their guide duct. For this reason, it is necessary to provide a greater stack length between the teeming point and the emptying point. This necessarily increases the period of time during which the casting remain in the chill molds thus increasing the thermal stresses.

The aforementioned difficulties are eliminated in the embodiment of the chill molds according to the present invention in that the depression of each chill mold is formed with a top edge extending transversely to the longitudinal direction of the stack, or the longitudinal direction in which the chill molds are moved, with this upper transverse edge operating to interrupt the melt flow. Since completely separate castings may be formed in this manner, the chill molds may be readily opened immediately after solidification of the castings. Additionally, the yield is considerably improved by eliminating the metal bridge or rope in the casting channel connecting the castings with each other.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENTS

Figure 1:
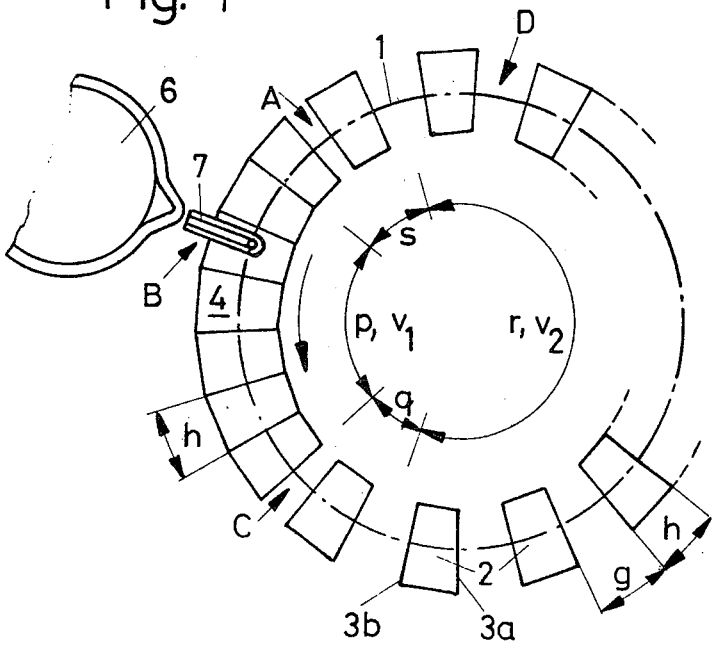
FIG. 1 is a plan view showing a schematic representation of an arrangement according to the present invention wherein a set of chill molds are arranged to move upon a circular path.

Referring now to the drawings wherein like reference numerals identify similar parts throughout the various figures thereof, there is shown in FIG. 1 an arrangement of chill molds in accordance with the present invention which are moved along a circular endless path. In the plan view of FIG. 1, a number of block-shaped chill molds 2 having similar outside dimensions run upon the circular endless path 1. Each chill mold 2 has a front joinder face 3*a* and a rear joinder face 3*b*. From each of these joinder faces there extends internally of the chill mold in a known manner a partial mold cavity which is recessed into the interior of the block-like body of the chill mold. It will be apparent that by bringing adjacent chill molds together so that the joinder face 3*a* of one is in abutting relationship with the joinder face 3*b* of another, the partial mold cavities in each of the chill molds will be brought together so that from two adjacent molds there will be obtained an overall complete mold cavity which may be poured from the top of the chill molds to form a casting. These details, although not depicted in FIG. 1, will be described more fully hereinafter with reference to FIGS. 3 and 4. In the simplified representation of FIG. 1, the guide means for the chill molds (preferably a ring shaped duct) as well as their driving elements have also been omitted.

The invention operates so that as the individual chill mold parts 2 are moved about the circular endless path 1 they are brought together with their joinder faces in abutting relationship over a portion of the endless path while being moved separated from each other over another portion of the endless path.

More specifically, as will be seen from FIG. 1, a portion of the circular track 1 is arranged so that the chill molds 2 form about a segment *p* of the circular track a closed horizontal stack 4 of chill molds. Within this segment of the circular track there is located a receiving point B which is indicated by a teeming ladle 6 and a pouring spout 7. The closed stack 4 extends up to the emptying point C where the respective front mold of the stack 4 is accelerated away from the stack over a distance *q* so that the solidified casting may be removed from the now separated joinder faces. A distance *g* between the joinder faces of adjacent molds is achieved with the temporary acceleration of a mold part and this distance is maintained over the balance of the portion of the revolving path indicated by segment *r* outside the closed stack.

In the operation of the device according to the present invention the mean velocity V2 of the chill mold sections as they move through the segment *r* of the circular path will be greater than the mean velocity Vl of the chill molds as they move as a closed horizontal stack through the segment *p*, since during the same time in which the mold width *h* is covered on section *p*, the path covered in section *r* is equal to the sum of the mold width and distance *g*. On their path, the molds 2 will finally arrive in section *s* on which they undergo a deceleration from the velocity V2 to the velocity V1 of the stack. It is important that each mold is conducted exactly in the longitudinal direction of the stack when closing up to the respective last mold of the stack 4 (point A). This permits a satisfactory undistrubed closing of the mold cavities, after cores have been inserted, for example, at point D.

As a result of the arrangement of the present invention, the chill molds as they are revolved around the circular endless path 1 will be arranged with their joinder faces 3 freely accessible as a result of the fact that they are maintained separated while moving around the endless path 1 outside of the horizontal stack 4. This now gives rise to the possibility of permitting work to be performed on the molds in various ways, and particularly to allowing access to the mold cavities. Accordingly, after passing through the emptying point C, the mold cavities may be checked and cleaned, if necessary by means of, for example, compressed air. Furthermore, one or more protective layers such as blackwash can be applied, if necessary, and it is particularly possible, as mentioned above, to insert cores before the joinder faces are again brought together in abutting relationship. The heat economy of the chill molds may also be effectively influenced in order to maintain a suitable operating temperature for teeming. The exposed joinder faces insure an effective cooling of the regions bonding the mold cavity, but in segment *r* an additional cooling or heating may be effected, for example, when the plant is put in operation.

The aforementioned advantages of the present invention permit the utilization of the chill casting method for the production of more complicated and demanding shapes for the castings involved and the achievement of short station time with an advantageous design of the chill molds and a long service life being possible.

Figure 2:
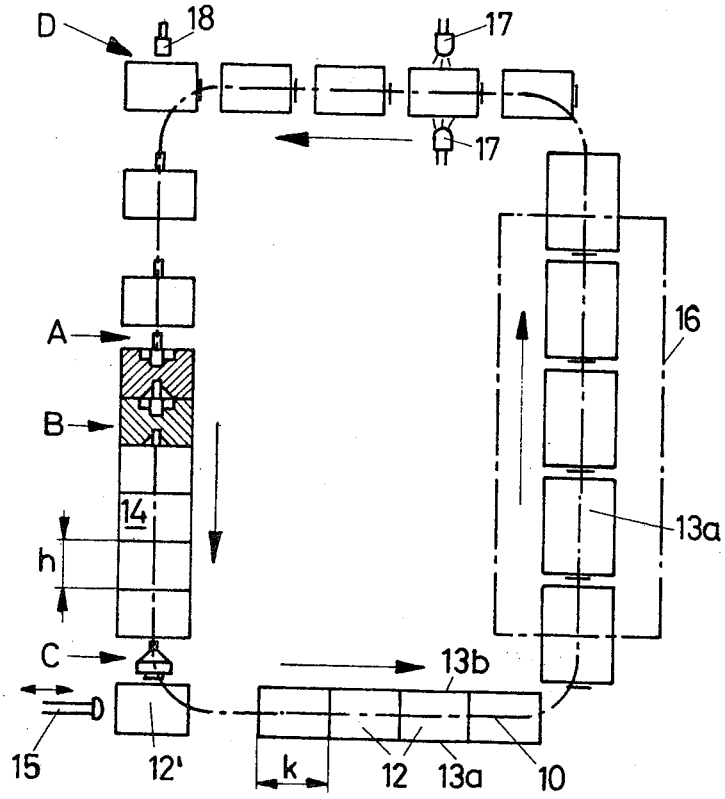
FIG. 2 shows in plan view a schematic arrangement wherein a set of chill molds are arranged to move within a generally quadrilateral path.

A further embodiment of the present invention is shown in FIG. 2 wherein instead of a circular endless path or track being provided, there is provided a chill casting method with a substantially quadrilateral or rectangular revolving track 10. In the embodiment according to FIG. 2 as well, a group of chill molds 12 are arranged along the endless path in the form of a closed horizontal stack 14 which extends from the closing point A′ past the teeming point B to the emptying point C. The chill mold 12′, which at this point is separated from the stack 14 by being accelerated, is subsequently deflected at a right angle, for example, by means of a plunger 15. In this manner, a mold stack without intervals is formed on an adjoining section of the track 10, but the joint faces 13*a*, 13*b* of the molds remain separated; that is, they are freely accessible at the length sides of this track. This is due to the fact that in the deflection by the plunger 15 the molds maintain their orientation in space but the alignment of the joint faces 13 relative to the direction of revolution is changed, since they are temporarily parallel to the revolving track. Along this stack the mold cavities in joinder faces may be easily checked and cleaned if necessary.

Subsequently, the chill molds are tipped successively by 90° and conveyed horizontally, that is, with the joinder faces 13*a*, 13*b* at the top and bottom respectively. Suitable for this purpose is, for example, a conveyor belt with drivers. The chill molds may be conducted, as mentioned above, through a channel 16 in which they may be cooled or heated as required.

After passing through this zone, the chill molds are again raised and conveyed standing in a transverse direction, for example, on another conveyor belt. Here too the joint faces of the molds are aligned with the revolving track and a blackwash may be applied advantageously in this zone in the range of the mold cavities, for example, by means of spray nozzles 17. At the end of this zone there is arranged a point D where a core 18 may be inserted into one of the partial mold cavities.

In the following deflection, the chill molds maintain their orientation in space, so that the joint faces are again transverse to the direction of the track. Subsequently, the chill molds are decelerated and open up again at point D in the longitudinal direction of the stack 14 to the last mold.

The many possibilities for influencing the chill molds described on the basis of FIG. 1 are also shown in the embodiment according to FIG. 2 but they are increased by the alternating relative position and velocity of the chill molds along the revolving track.

The velocities of the chill molds within the zones *p* and A–C, respectively, and *r* and C–A, respectively, are maintained, for example, by separate belt conveyors running at different speeds. Between the individual conveyors the chill molds are accelerated or decelerated by additional means, for example, controlled grips.

Figure 3:
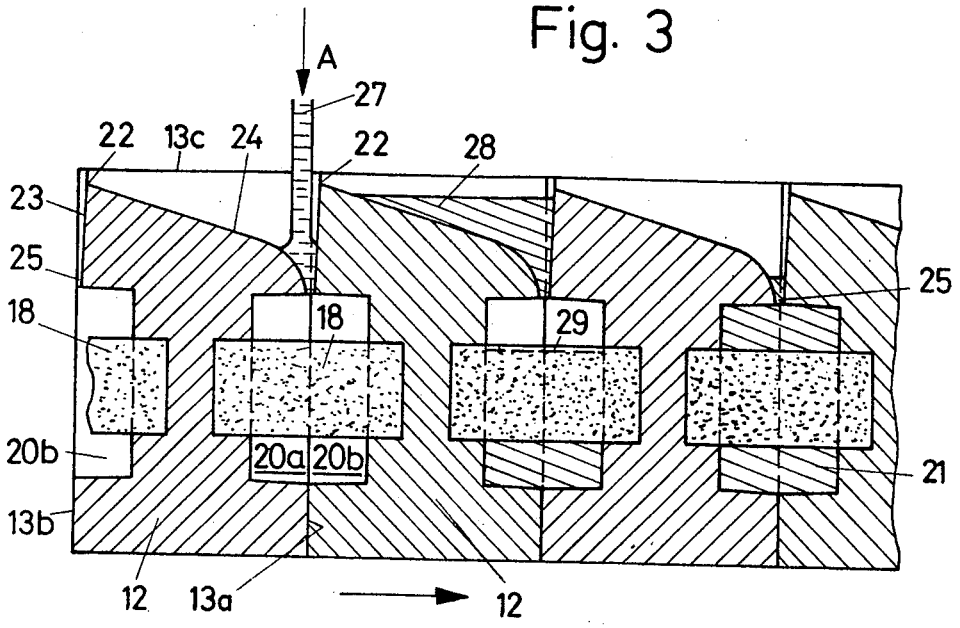
FIG. 3 is a vertical sectional view taken through a set of chill molds arranged in a closed horizontal stack.
Figure 4:
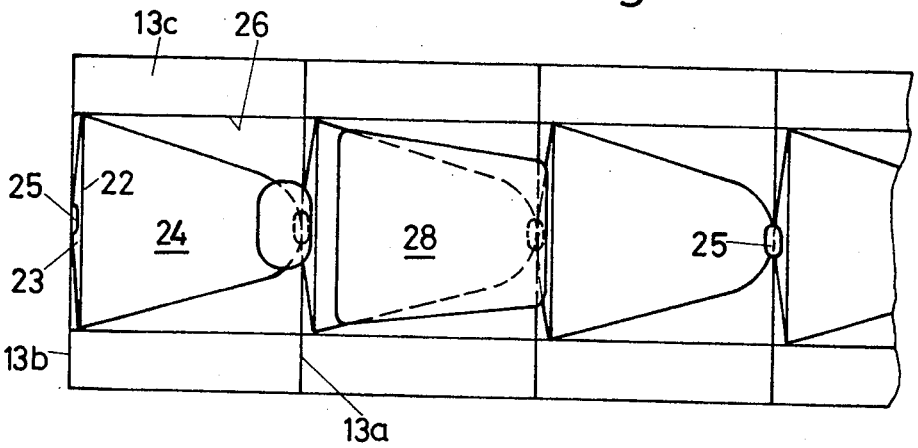
FIG. 4 is a top view of the stack of chill molds shown in FIG. 3.

In FIGS. 3 and 4 there are shown details of the shaping of the chill molds and of the casting process within the area where the molds are maintained as a closed horizontal stack. The vertical section (FIG 3) shows in each chill mold the front partial mold cavity 20a and the rear partial mold cavity 20*b*, as well as an inserted sand core 18. The upper side 13*c* of each chill mold has a depression, whose inclined side walls approach a bottom with bottom parts 23, 24 which drop sharply toward the rear joinder face 13*b* and become flatter in the range of the front joinder face 13*a*. The depressions, arranged in series in the stack, form a continuous casting channel 26 and are connected over sprue openings 25 with the mold cavities. The highest point of each depression is formed by an upper edge 22 extending below the top side 13*c* transversely to the casting channel 26. This upper or top edge 22 is arranged preferably close to the rear joinder face 13*b*. From the top edge 22, a part 23 of the bottom depression drops sharply to the rear joinder face 13*b* and to the sprue opening 25 while another part 24 of the bottom drops with substantially less inclination toward the front joinder face 13*a*.

The mode of operation of the depressions or "pouring gate" formed in the aforementioned manner may likewise be seen from FIG. 3 and from FIG. 4. The mold cavity shown in FIG. 3 farthest to the right has just been filled completely with melt, which solidifies partially to the casting 21. Above the mold cavity there is only a small amount of metal in the sprue opening 25. The mold cavity farther to the left is only partially filled up to a level 29. In the depression thereabove there is a melt supply 28 which flows into the mold cavity until the end state represented on the right is reached. The amounts of melt in the following depressions of casting channel 26 are separated from the beginning by the interspaced top edges 22, and separate castings are formed so that the chill molds may be readily opened at an emptying point D. The chill mold 12 represented furthest to the left in FIG. 3 and in FIG. 4 has just arrived at teeming point A or at casting jet 27 during the continuous or intermittent feed of the stack. Due to the above-described position of the top edges 22 located near the rear joinder faces, the casting jet 27 will strike directly the following sprue opening 25 immediately after the passage of a top edge 22. Thus, the melt is only slightly cooled in the chill mold during the casting of the following mold cavity. The rate of flow of the melt per unit of time in the casting jet is preferably greater than the absorption capacity through sprue opening 25 so that a metal sump is immediately formed in the pouring gate. The casting jet 27 is absorbed by this metal sump during the further movement of the chill mold without being cooled first on the surface of the mold. This measure prevents effectively a chilling or "freezing" of the melt as well as the formation of cold shots in the castings.

By adapting the mean velocity of feed of the mold stack and the rate of flow of the casting jet to the casting weight per kilogram chill molds in the volume of the mold cavity respectively, a constant amount of metal may be obtained in the sprue opening and pouring gate, respectively, both in the continuous and in the periodic interrupted casting jet 27. Depending upon the casting requirements, a high yield may thus be achieved.

The situation described with regard to FIGS. 3 and 4 naturally also applies to the chill mold revolving arrangements according to FIG. 1 or FIG. 2. The aforedescribed method according to the invention may be used for various casting metals and a wide range of individual weights. In particular, the method is suitable for casting iron materials with low individual weights and short station times.

While specific embodiments of the invention have been shown and described in detail to illustrate the application of the inventive principles, it will be understood that the invention may be embodied otherwise without departing from such principles.

I claim:

1. A method for chill casting discrete articles by means of a set of individual separable permanent molds each having opposed front and rear joinder faces with a partial mold cavity formed therein, with abutment of the joinder faces of adjacent molds bringing said partial mold cavities together to form a completed discrete mold cavity, said method comprising the steps of individually recirculating said molds about an endless path, moving said molds along a portion of said endless path past a teeming point with part of said molds temporarily formed in a horizontal stack with the rear joinder face of each mold in abutting relationship with the front joinder face of the following mold, and moving said molds to an emptying point where said molds are temporarily accelerated away from said stack, said permanent molds being moved on their respective paths outside said stack with said joinder faces of successive molds kept spaced from each other and each being conducted in the longitudinal direction of said stack when closing up to the respective last mold of the stack.

2. A method according to claim 1 wherein said chill molds are moved after their acceleration at said emptying point at a mean velocity that is higher than the mean velocity of movement of said stack up to the closing point of said stack.

3. A method according to claim 1 wherein said molds are moved such that the alignment of said joinder faces of each mold is changed temporarily relative to the direction of movement of said molds on said endless path when said molds move at portions of said endless path other than said stack.

4. A method according to claim 3 wherein said molds are moved temporarily with said joinder faces parallel to the direction of movement of said molds on said endless path.

5. A method according to claim 1 wherein said endless path upon which said molds are moved is a circular track.

6. A method according to claim 1 wherein said endless path upon which said molds are moved is a substantially quadrilateral track.

7. A method according to claim 6 wherein as said molds are moved about said quadrilateral endless path, said joinder faces of said molds are maintained perpendicular to the direction of movement over two sides of said quadrilateral path and parallel to the direction of movement over the other two sides of said path.

8. A method for chill casting discrete articles by means of a set of individually separable permanent molds each having joinder faces on opposed sides thereof with a partial mold cavity formed therein, said molds being formed to define from an adjacent pair of said partial mold cavities a completed discrete mold cavity by abutment of the joinder faces of adjacent molds, said method comprising the steps of continuously circulating said molds in series through a given path, defining said given path to include at least one section thereof through which said molds are moved in the form of a horizontal stack past a teeming point with joinder faces of each mold within said stack being in abutting relationship with a joinder face of an adjacent mold to form therebetween said completed discrete mold cavity, moving said molds in said horizontal stack uniformly at a first velocity throughout said at least one section of said path to maintain said molds in abutting relationship within said stack, accelerating each of said molds individually to a velocity higher than said first velocity at the forward end of said at least one section taken in the direction of travel of said molds to individually serially remove said molds from said stack and thereby separate joinder faces to open a completed cavity, moving said molds while in a spaced apart arrangement at a velocity higher than said first velocity at least through the portion of said given path immediately preceding said at least one section thereof, and individually decelerating said molds to said first velocity as they enter said at least one section of said path in order to bring each of said molds into abutting relationship with the adjacent mold immediately forwardly thereof to add said decelerated mold to said horizontal stack, with molds being thereby added to and removed from said horizontal stack merely by controllably varying the velocity thereof as said molds move through said at least one section of said path and through the portions of said path adjacent the forward and rearward end of said at least one section thereof.

* * * * *